US009157251B2

(12) United States Patent
Newman et al.

(10) Patent No.: US 9,157,251 B2
(45) Date of Patent: Oct. 13, 2015

(54) REPLACEABLE DUCTILE FUSE

(71) Applicant: BURNS & MCDONNELL ENGINEERING COMPANY, INC., Kansas City, MO (US)

(72) Inventors: Nathan G. Newman, Manchester, MO (US); Kevin P. Heffern, St. Louis, MO (US)

(73) Assignee: BURNS & MCDONNELL ENGINEERING COMPANY, INC., Kansas City, MO (US)

( * ) Notice: Subject to any disclaimer, the term of this patent is extended or adjusted under 35 U.S.C. 154(b) by 0 days.

(21) Appl. No.: 14/340,876

(22) Filed: Jul. 25, 2014

(65) Prior Publication Data

US 2015/0128506 A1 May 14, 2015

Related U.S. Application Data

(60) Provisional application No. 61/903,534, filed on Nov. 13, 2013.

(51) Int. Cl.

| | |
|---|---|
| ***E04H 9/02*** | (2006.01) |
| ***E04B 1/38*** | (2006.01) |
| ***E04B 1/92*** | (2006.01) |

(52) U.S. Cl.

CPC *E04H 9/027* (2013.01); *E04B 1/38* (2013.01); *E04B 1/92* (2013.01)

(58) Field of Classification Search

CPC ..... E04H 9/02; E04H 9/21; E04H 9/24; E04H 9/25; E04H 9/27; E04B 1/36; E04B 1/98; E04B 1/92; E04B 1/38; E03D 27/34

USPC ..... 52/745.21, 167.4, 167.1, 704, 708

See application file for complete search history.

(56) References Cited

U.S. PATENT DOCUMENTS 3,521,413 A * 7/1970 Scott et al. ..... 52/98
3,630,474 A * 12/1971 Minor ..... 52/98

(Continued)

FOREIGN PATENT DOCUMENTS

CH 649364 A * 5/1985 ..... F16M 7/00
JP 01320345 A * 12/1989 ..... F16F 13/00
WO WO 2013/021349 2/2013

OTHER PUBLICATIONS

Samer El-Bahey, Michel Bruneaub; Buckling restrained braces as structural fuses for the seismic retrofit of reinforced concrete ridge bents; Engineering Structures 33 (2011) 1052-1061; Elsevier.

(Continued)

*Primary Examiner* — Christine T Cajilig
(74) *Attorney, Agent, or Firm* — Stinson Leonard Street LLP

(57) ABSTRACT

A fuse and a method of using the fuse to removably couple a structure to an anchor preferably partially embedded in concrete. The fuse is configured to be removably coupled to the anchor so that the fuse is positioned in a load path between the anchor and the structure. The fuse is configured to deform in a ductile manner when the structure exerts a force on the fuse that causes a stress in the fuse which exceeds an elastic limit of the fuse. The fuse may be decoupled from the anchor without altering the concrete, the anchor, and the structure. If the structure exerts a force on the fuse that causes the fuse to deform in a ductile manner, the fuse may be decoupled from the anchor and replaced with another fuse.

18 Claims, 10 Drawing Sheets

(56) References Cited

U.S. PATENT DOCUMENTS

| | | | | |
|---|---|---|---|---|
| 3,695,139 | A * | 10/1972 | Howe | 411/432 |
| 4,617,769 | A | 10/1986 | Fyfe et al. | |
| 5,163,256 | A * | 11/1992 | Fukumoto et al. | 52/167.1 |
| 5,797,228 | A | 8/1998 | Kemeny | |
| 5,899,043 | A * | 5/1999 | Reay | 52/707 |
| 5,971,374 | A * | 10/1999 | Freeman | 267/134 |
| 6,134,858 | A * | 10/2000 | Gutelius et al. | 52/698 |
| 6,631,592 | B1 * | 10/2003 | Hancock | 52/167.4 |
| 7,732,708 | B1 | 6/2010 | Peabody | |
| 8,001,734 | B2 * | 8/2011 | Pryor et al. | 52/167.3 |
| 8,037,651 | B2 * | 10/2011 | Dent | 52/296 |
| 8,196,368 | B2 | 6/2012 | Sarraf | |
| 8,353,135 | B2 | 1/2013 | Sarkisian | |
| 8,511,025 | B2 * | 8/2013 | Kawai et al. | 52/393 |
| 8,789,327 | B2 * | 7/2014 | Junes | 52/297 |
| 8,881,485 | B2 * | 11/2014 | Sritharan et al. | 52/651.07 |
| 8,881,491 | B2 * | 11/2014 | Christopoulos et al. | 52/741.3 |
| 2003/0143038 | A1 * | 7/2003 | Babcock | 405/259.1 |
| 2008/0156587 | A1 | 7/2008 | Lara | |
| 2010/0242380 | A1 * | 9/2010 | Von Waldow | 52/167.4 |
| 2010/0319271 | A1 * | 12/2010 | Sarraf | 52/98 |
| 2011/0107699 | A1 * | 5/2011 | Kawai et al. | 52/393 |
| 2011/0272190 | A1 | 11/2011 | Rouse et al. | |
| 2012/0180423 | A1 * | 7/2012 | Avila | 52/700 |
| 2013/0283709 | A1 | 10/2013 | Christopoulos et al. | |

OTHER PUBLICATIONS

American Concrete Institute; Building Code Requirements for Structural Concrete (ACI 318-11), Aug. 2011; pp. 1-6 & 417-426.

International Search Report and Written Opinion dated Mar. 20, 2015 for PCT/US2014/62770, 15 pages.

* cited by examiner

REPLACEABLE DUCTILE FUSE

CROSS-REFERENCE TO RELATED APPLICATIONS

This application is based on and claims priority to U.S. Provisional Application Ser. No. 61/903,534, filed on Nov. 13, 2013, which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention is directed to a replaceable ductile fuse, and in particular, to a replaceable ductile fuse configured to be positioned in the load path between an anchor preferably partially embedded in concrete and a structure.

2. Description of Related Art

Structural elements, such as a building column, are commonly joined to a supporting concrete foundation with an anchor that is partially embedded in the concrete and coupled to the structural element. In the case of a building column, the column may have a baseplate with an opening that receives a portion of the anchor. A nut may be threaded on the anchor to clamp the baseplate between the nut and concrete foundation.

The American Concrete Institute's Building Code Requirements for Structural Concrete (ACI 318) specifies certain requirements for the connection between a structural element and a concrete anchor, including seismic design requirements that are applicable when the structure is located in an area that may be subject to seismic loads. Designing the connection so that it deforms in a ductile manner is in part at least one way to satisfy the seismic design requirements.

One current technique for designing such a connection so that it satisfies the seismic design requirements of ACI 318 includes designing the anchor rod so that it fails in a ductile manner before failure of the concrete within which the rod is embedded. After the anchor rod fails, however, it is costly and time-consuming to replace the anchor rod. Other techniques include adding concrete reinforcing steel which is developed on both sides of the concrete breakout cone thereby making the tensile failure model no longer dependent upon concrete failure modes, or overdesigning the connection by a certain percentage. These techniques, however, may be costly and time-consuming to implement.

BRIEF SUMMARY OF THE INVENTION

The present invention is directed to a fuse and a method of using the fuse to removably couple a structure to an anchor preferably partially embedded in concrete. The fuse is configured to be removably coupled to the anchor so that the fuse is positioned in a load path between the anchor and the structure. The fuse is configured to deform in a ductile manner when the structure exerts a force on the fuse that causes a stress in the fuse which exceeds an elastic limit of the fuse. The fuse may be decoupled from the anchor without altering the concrete, the anchor, and the structure. If the structure exerts a force on the fuse that causes the fuse to deform in a ductile manner, the fuse may be decoupled from the anchor and replaced with another fuse. The fuse may be coupled to the anchor so that when the structure exerts a force on the fuse, the resultant stress caused in the fuse is a tensile, compressive, flexural, or shear stress, or some combination of the foregoing.

The fuse may be part of a fuse assembly including a connector that couples the fuse to the anchor, and a housing that is coupled to the fuse and to the connector so that the fuse is in a load path between the housing and the connector. The fuse is preferably configured to deform in a ductile manner when a force exerted on the housing by the structure causes a stress in the fuse which exceeds an elastic limit of the fuse. The housing preferably comprises a hexagonal tube that may be engaged for rotation by a conventional wrench and/or socket, and the connector preferably comprises a nut that may engage threads on the anchor. The fuse preferably comprises at least one rod positioned within the hexagonal tube that is placed in tension when the structure exerts a force on the housing in the direction away from the concrete surface.

The designer of a structure preferably may use the fuse to couple the structure to a concrete embedded anchor in such a way that the connection between the structure and anchor satisfies the requirements of the American Concrete Institute's Building Code Requirements for Structural Concrete (ACI 318) and in particular the seismic design requirements therein. The fuse is configured so that it deforms in a ductile manner when a predetermined amount of force is exerted on the fuse by the structure. After the fuse deforms, the deformation is visual, and the fuse may be removed and replaced without costly modifications to the structure, anchor, and concrete and with little or no downtime for the structure. The fuse provides a simple method of dictating a ductile failure limit state on a connection, especially when implemented in a moderate to high seismic zone where a ductile failure is mandated by current building codes.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
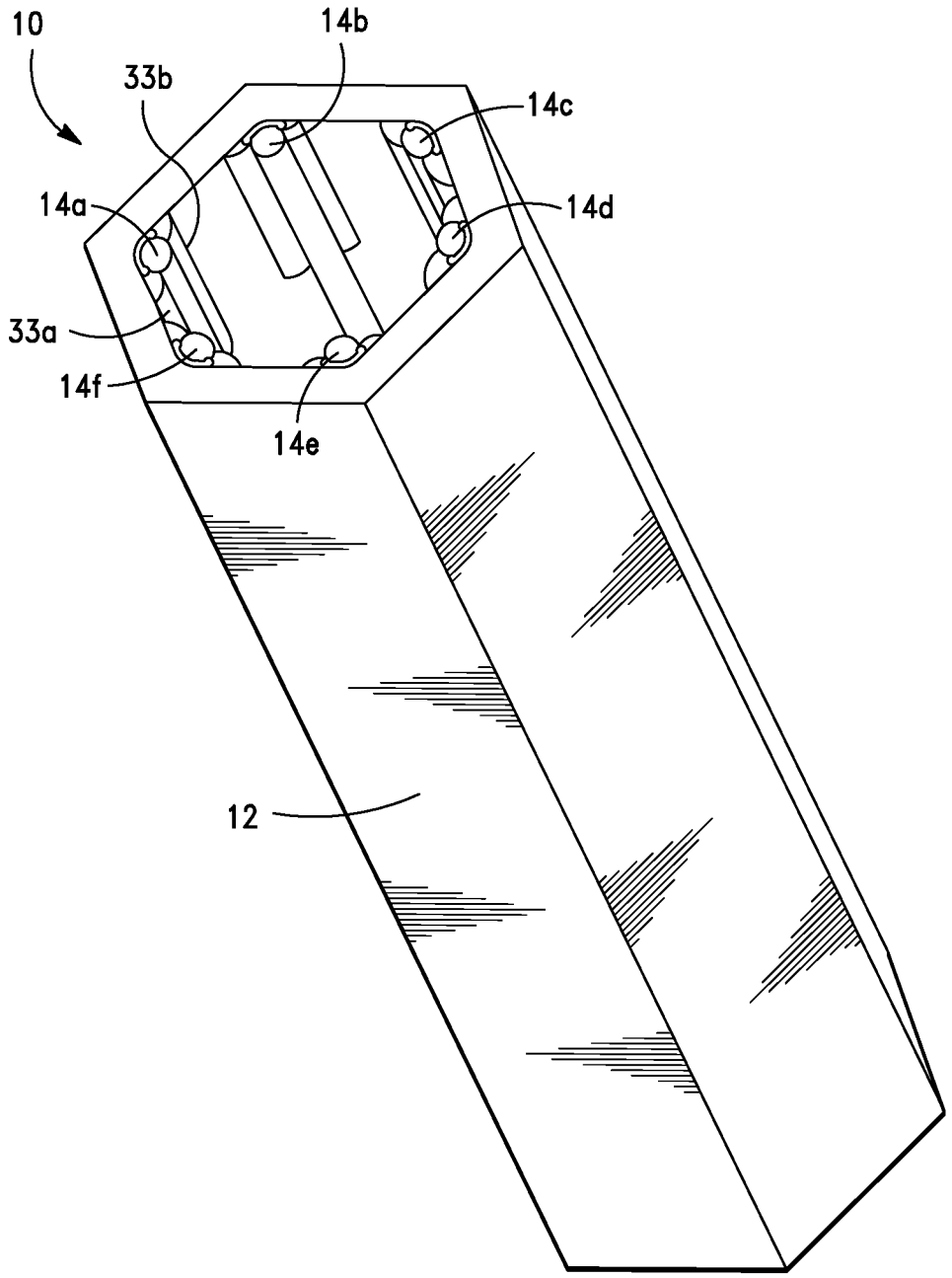
FIG. 1 is a perspective view of a fuse assembly in accordance with an embodiment of the present invention.

Referring to FIG. 1, a fuse assembly in accordance with one embodiment of the present invention is identified generally as 10. Fuse assembly 10 is designed to engage the threads of an anchor bolt, which is preferably partially embedded in concrete, to secure a portion of a structure, such as a column base plate, to the anchor bolt. Fuse assembly 10 includes at least one fuse that is positioned in the load path between the structure and the anchor bolt. The fuse is configured to deform in a ductile manner when the structure is subjected to a load exceeding the rated threshold of the fuse, which causes a stress in the fuse exceeding an elastic limit of the fuse. The fuse is designed to be an intentional weak link in the load path between the structure and the anchor bolt so that the fuse will deform in a ductile manner before the structure, anchor bolt, and concrete embedding the anchor bolt are damaged. After the fuse deforms in a ductile manner, fuse assembly 10 may be disengaged from the anchor bolt and replaced with a new fuse assembly 10 without altering or damaging the structure, the anchor bolt, and the concrete embedding the anchor bolt.

Figure 2:
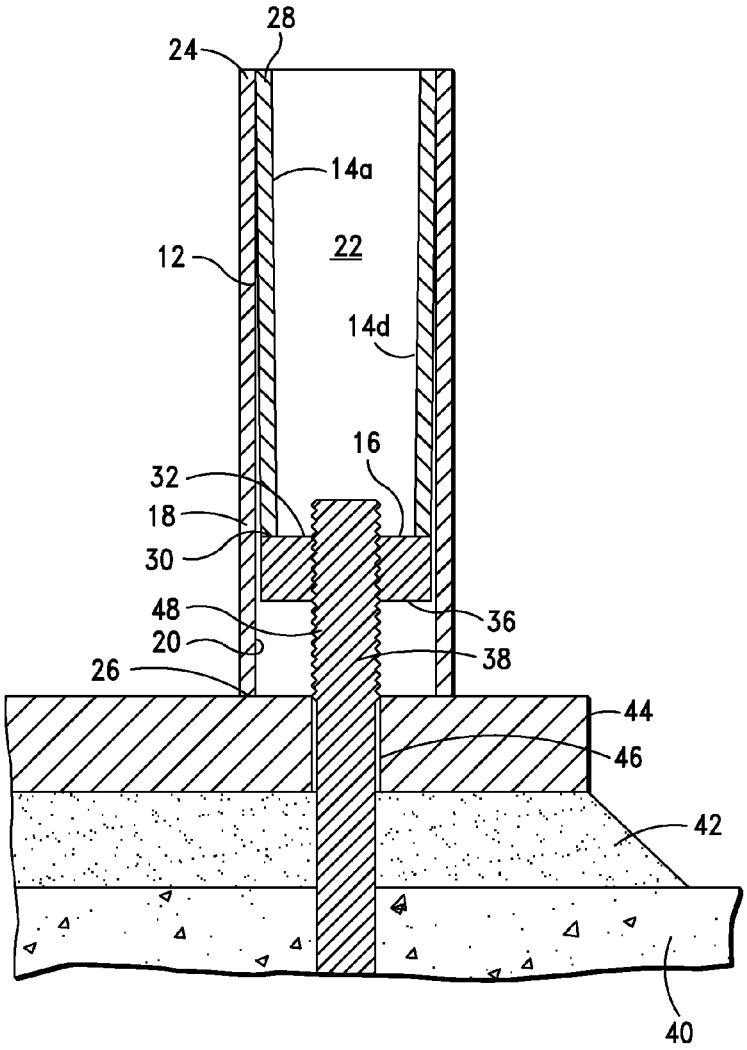
FIG. 2 is a cross-sectional view taken through the line 2-2 in FIG. 3.
Figure 3:
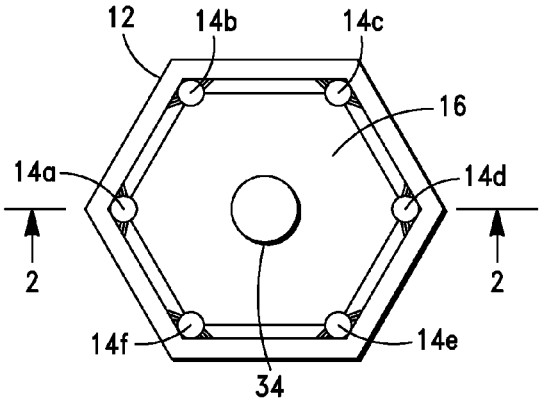
FIG. 3 is a top plan view of the fuse assembly shown in FIG. 1.

Referring to FIGS. 2 and 3, fuse assembly 10 includes a housing 12, six fuses 14*a-f* each joined to the housing 12, and a nut 16 joined to each of the fuses 14*a-f*. Housing 12 is a hexagonal tube with an outer surface 18 preferably dimensioned so that it may be engaged for rotation by a conventional SAE or metric sized wrench and/or socket. Housing 12 has an inner surface 20 surrounding a channel 22 within which fuses 14*a-f* and nut 16 are positioned. Housing 12 has a top end 24 and a bottom end 26. Notches (not shown) can be added to the bottom end 26 of the housing 12 and in the wall of the housing 12 just above nut 16 to allow drainage of water collected within channel 22.

Each of fuses 14*a-f* is substantially similar. Accordingly, only fuse 14*a* is described in detail herein. Fuse 14*a* is a cylindrical rod having a top end 28 and a bottom end 30. The top end 28 of fuse 14*a* is joined to the inner surface 20 of housing 12 at the top end 24 of housing 12. The bottom end 30 of fuse 14*a* is joined to nut 16. Fuse 14*a* is positioned adjacent the location where two of the hexagonal housing 12 walls meet. Fuses 14*b-f* are each positioned adjacent the juncture of two other walls of the hexagonal housing 12. Fuse 14*a* is preferably joined to the inner surface 20 of housing 12 and to an upper surface 32 of nut 16 by welding, chemical adhesion, or mechanical interlock; however, it is within the scope of the invention for fuse 14*a* to be joined to the housing 12 and nut 16 in any manner known in the art. FIG. 1 shows welds 33*a* and 33*b* joining each side of fuse 14*a* to housing 12.

Fuses 14*a-f* are each made from a ductile material having an elastic limit. When each fuse 14*a-f* is subjected to a stress below its elastic limit, the fuse 14*a-f* deforms elastically and generally returns to its original shape when the force creating the stress is removed. Deformation of each fuse 14*a-f* when subjected to a stress below its elastic limit is preferably proportional to the stress. When each fuse 14*a-f* is subjected to a stress that is above the elastic limit, the fuse 14*a-f* begins to deform plastically such that a portion of the deformation resulting from the stress is irreversible. Once each fuse 14*a-f* is subjected to a stress that is above the elastic limit, relatively small additional increases in the stress result in relatively large deformations of the fuse 14*a-f*. Stress increase above the elastic limit preferably results in larger deformation than a corresponding level of stress increase below the elastic limit. Preferably, each fuse 14*a-f* is made from ductile steel.

Nut 16 is hexagonal and has outer dimensions sized so that the nut 16 may be received by channel 22 and is slightly smaller than the inner dimension of inner surface 20 of housing 12. The nut 16 has an opening 34 through its center surrounded by a threaded surface. Nut 16 has upper surface 32 joined to each of fuses 14*a-f* and a bottom surface 36. Housing 12 has a greater length than the combination of fuse rods 14*a-f* and nut 16 such that the bottom surface 36 of nut 16 is spaced above the bottom end 26 of housing 12. Nut 16 may be a conventional SAE or metric sized nut, but could also be formed to have any dimensions by being machined from a steel plate or other material. Nut 16 may also include an insert, made of nylon or a similar material, to create a locking type nut assembly.

Fuse assembly 10 is shown in FIG. 2 with nut 16 in threaded engagement with an anchor bolt 38. A lower portion of anchor bolt 38 is embedded in concrete 40. Anchor bolt 38 extends through an optional layer of optional grout 42 positioned on top of concrete 40. A baseplate 44 of a structure is positioned on top of optional grout 42. Baseplate 44 includes an opening 46 through which anchor bolt 38 passes. The structure may be a building, which includes a column to which baseplate 44 is joined. An upper portion of anchor bolt 38 includes a threaded outer surface 48. Anchor bolt 38 is preferably any type of conventional anchor bolt designed to be partially embedded in concrete. Anchor bolt 38 may be cast into the concrete or post installed.

The threaded inner surface of nut 16 engages the threaded outer surface 48 of anchor bolt 38, and a lower surface at the bottom end 26 of housing 12 abuts an upper surface of baseplate 44 to clamp baseplate 44 between concrete 40 and housing 12. Housing 12 may be engaged with a conventional wrench or socket and rotated to a final position. As housing 12 is rotated, nut 16 rotates around bolt 38. Housing 12 is positioned so that the upper portion of anchor bolt 38 is received within channel 22. When fuse assembly 10 is installed as shown in FIG. 2, the lower surface 36 of nut 16 is spaced above the upper surface of baseplate 44.

When the structure joined to baseplate 44 is subjected to a loading event that exerts a force in the direction away from concrete 40 on the structure and baseplate 44, baseplate 44 exerts a force in the direction away from concrete 40 on housing 12. Housing 12 exerts a force in the direction away from concrete 40 on the top end 28 of each of fuses 14*a-f*. A force in the direction towards concrete 40 is exerted on the bottom end 30 of each of fuses 14*a-f* because each fuse 14*a-f* is joined to nut 16, which engages anchor bolt 38 that is partially embedded in concrete 40. The force in the direction away from concrete 40 exerted on each fuse 14*a-f* by housing 12 and the force in the direction towards concrete 40 exerted on each fuse 14*a-f* by nut 16 places each of fuses 14*a-f* in tension. Each of fuses 14*a-f* is placed in the load path between concrete 40 and the baseplate 44 of the structure and in the load path between housing 12 and nut 16. The forces placing each of fuses 14*a-f* in tension creates a tensile stress in each fuse 14*a-f*. As these forces increase, the tensile stress in each fuse 14*a-f* increases, and each fuse 14*a-f* deforms by extending in length. If the tensile stress does not exceed the elastic limit of the fuses 14*a-f*, the fuses 14*a-f* will return to, or near, their original shape after the force causing the stress subsides. If the tensile stress in each fuse 14*a-f* exceeds the elastic limit of each fuse 14*a-f*, each fuse 14*a-f* begins to deform in a ductile manner and deform plastically, as described above. As the fuses 14*a-f* deform and their length increases, the baseplate 44 and housing 12 move in the direction away from concrete 40 approximately the same distance as the increase in length of the fuses 14*a-f*, which reduces the distance between the bottom surface 36 of nut and baseplate 44.

When fuses 14*a-f* begin to deform in a ductile manner, the other elements in the load path between the concrete 40 and baseplate 44 of the structure, which are the concrete 40, anchor bolt 38, nut 16, housing 12, and baseplate 44, preferably do not fail because the fuses 14*a-f* in combination are designed to deform in a ductile manner prior to failing these other elements. When the fuses 14*a-f* deform in a ductile manner, a person viewing the fuses 14*a-f* and/or the structure joined to baseplate 44 is preferably able to notice that the fuses 14*a-f* have plastically deformed due to elongation of the fuses 14*a-f* and/or movement of the structure joined to baseplate 44. After the fuses 14*a-f* plastically deform, the deformed fuse assembly 10 may be removed from threaded engagement with anchor bolt 38 and replaced with another fuse assembly 10 having fuses 14*a-f* that have not yet undergone plastic deformation. The deformed fuse assembly 10 may be removed and replaced without altering or damaging the concrete 40, anchor bolt 38, baseplate 44, and the structure joined to the baseplate 44. The terms "fail," "failure," and "failing" as used herein with reference to a structural element mean that the element experiences a load in excess of its limiting code-defined resistance.

Although the drawings show fuse assembly 10 in a vertical orientation, it is also within the scope of the invention to use fuse assembly 10 in any other orientation. For example, fuse assembly 10 may be used in a horizontal orientation when rod 38 extends horizontally outward from concrete 40. Fuse assembly 10 may also be used in a vertical orientation that is 180 degrees from the orientation shown in FIG. 2 when rod 38 extends vertically downward from concrete 40. Because fuse assembly 10, and fuse assemblies 100, 200, 300, 400, 500, 600, 700, and 800 described below, may be used in any orientation, but are shown in the drawings in a vertical orientation, for the purpose of this application, the terms "lower" or "bottom" can be understood to mean the side, surface or end of an object that is nearest to the concrete; the terms "upper" or "top" can be understood to mean the side, surface or end of an object that is farthest from the concrete; the term "below" can be understood to mean nearer to the concrete; and the term "above" can be understood to mean farther from the concrete.

Specifications of fuse assembly 10 that may be modified in order to ensure that the fuses 14*a-f* deform prior to failing of these other elements include the number of fuses 14*a-f*, the diameter of each fuse 14*a-f*, the length of each fuse 14*a-f*, the cross-sectional shape of each fuse 14*a-f*, and the material from which each fuse 14*a-f* is constructed. Modifications of any of these specifications are within the scope of the invention. The fuse assembly 10 is preferably designed so that the fuses 14*a-f* within the assembly 10 deform in a ductile manner at a predetermined force exerted on the housing 12 by the baseplate 44 of the structure. The fuse assembly 10 may be marked with this force so that the assembly 10 may easily be selected for a particular application based on this force. The invention may include a plurality of different fuse assemblies, similar to fuse assembly 10, that each begin to deform in a ductile manner at a different predetermined force enabling a designer to choose from one of the plurality of fuse assemblies for use in a particular application. Further, the invention may include a plurality of different fuse assemblies with different sets of fuse assemblies each set including fuse assemblies that are configured to be installed on a different diameter of anchor bolt 38 than the other sets. Each set of fuse assemblies configured for installation on a particular anchor bolt diameter may include fuse assemblies that each begin to deform in a ductile manner at a different predetermined force.

Housing 12, fuses 14*a-f*, and nut 16 may be made from any suitable material, and each may be coated with a desired material. For example, the fuse assembly 10 could be formed from materials and/or coated in order to prevent corrosion of the fuse assembly 10 and extend its service life. Fuse assembly 10 may be made entirely from stainless steel or galvanized in order to prevent corrosion.

While nut 16 is described as a conventional nut having a threaded inner surface that engages threads on anchor bolt 38, it is within the scope of the invention to replace nut 16 with another type of connector that is designed to removably engage anchor bolt 38, and it is within the scope of the invention to modify anchor bolt 38 so that it may be engaged by such a connector. For example, the nut 16 may mechanically interlock with anchor bolt 38 in any manner instead of nut 16 and anchor bolt 38 having threads that engage each other. It is also within the scope of the invention to modify the shape of the housing 12 and nut 16 so that they do not have a hexagonal cross-section. For example, housing 12 and nut 16 may be modified to have a square cross-section. In such a configuration, there may be four fuses, one positioned at each corner of the housing 12.

One method for manufacturing fuse assembly 10 includes laser cutting nut 16 from a plate of steel, including cutting opening 34 through the center of nut 16. Each of fuses 14*a-f* is then cut to a desired length from a cylindrical rod. Each of fuses 14*a-f* is welded to the upper surface 32 of nut 16. Threads are cut into the surface surrounding opening 34 in nut 16. A section of steel tubing is cut to form housing 12. The inner surface 20 of housing 12 is heavily coated with grease except for the location where fuses 14*a-f* are welded to housing 12. Nut 16 and fuses 14*a-f* are then inserted into the channel 22 within housing 12, and fuses 14*a-f* are welded to housing 12.

Figure 4A:
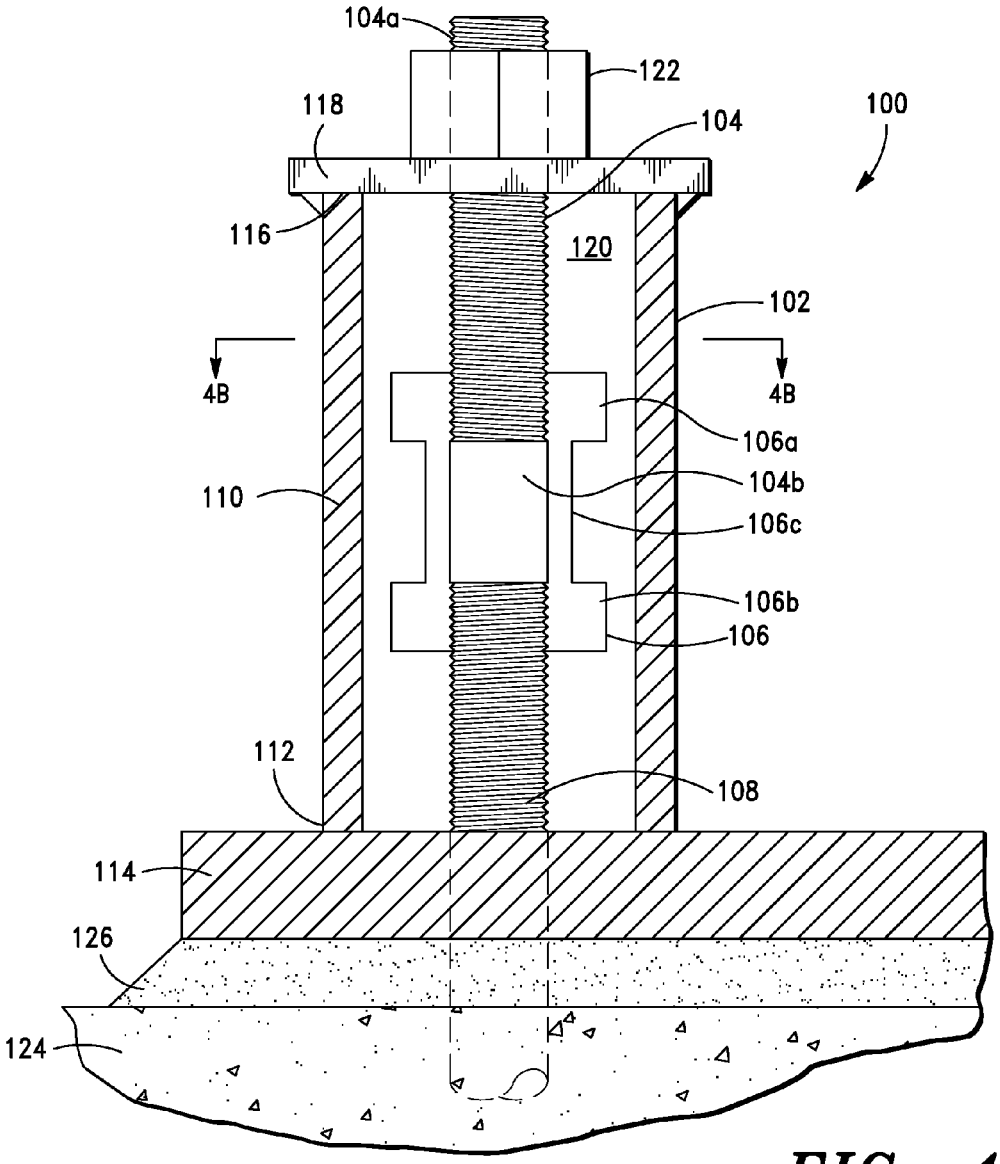
FIG. 4A is a side partial cross-sectional view of an alternative embodiment of fuse assembly in accordance with the present invention.
Figure 4B:
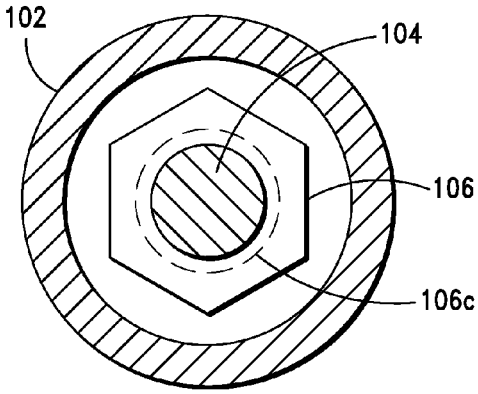
FIG. 4B is a cross-sectional view taken through the line 4B-4B in FIG. 4A.

An alternative embodiment of fuse assembly is identified in FIG. 4A generally as 100. Fuse assembly 100 includes a housing 102, a rod 104 coupled to one end of the housing 102, and a coupler 106 joining the rod 104 to an anchor bolt 108. Housing 102 includes a cylindrical tube 110 having a bottom end 112 that abuts a baseplate 114 and a top end 116 joined to circular plate 118. Plate 118 is preferably joined to tube 110 by welding, but may be joined in any suitable manner. Tube 110 has an inner surface surrounding a channel 120 within which is positioned coupler 106, a portion of anchor bolt 108, and a portion of rod 104. Plate 118 has a central opening (not shown) for receiving a portion of rod 104.

Rod 104 is a cylinder having an outer surface that is at least threaded at its ends 104*a* and 104*b*. End 104*a* extends through plate 118. A nut 122 engages the threads at end 104*a* and abuts plate 118 to couple rod 104 to the top end 116 of housing 102.

Coupler 106 has hexagonal ends 106*a* and 106*b* with a cylindrical fuse 106*c* extending between ends 106*a-b*. A central threaded opening passes through the center of coupler 106 and engages the threads on end 104*b* of rod 104 and anchor bolt 108. Fuse 106*c* has a smaller outer diameter than hexagonal ends 106*a* and 106*b* so that fuse 106*c* deforms in a ductile manner prior to failure of ends 106*a* and 106*b*. Fuse 106*c* is formed from a ductile material having an elastic limit in a similar manner as the fuses 14*a-f* described above.

Fuse assembly 100 engages anchor bolt 108 to clamp baseplate 114 between fuse assembly 100 and concrete 124, within which anchor bolt 108 is partially embedded. Baseplate 114 is positioned on top of optional grout 126 and concrete 124. Baseplate 114 includes an opening through which anchor bolt 108 passes. Fuse assembly 100 is installed by first threading coupler 106 on anchor bolt 108. Rod 104 may then be threaded into coupler 106 such that there is a gap between rod 104 and anchor bolt 108 adjacent fuse 106*c*. Housing 102 is placed over coupler 106 and anchor bolt 108, and nut 122 is threaded on rod 104.

When a structure joined to baseplate 114 is subjected to a loading event that exerts a force in the direction away from concrete 124 on the structure and baseplate 114, baseplate 114 exerts a force in the direction away from concrete 124 on housing 102. Housing 102 exerts a force in the direction away from concrete 124 on nut 122, which exerts a force in the direction away from concrete 124 on rod 104. Rod 104 exerts a force in the direction away from concrete 124 on end 106*a* of coupler 106, and anchor bolt 108 exerts a force in the direction towards concrete 124 on end 106*b* of coupler 106. The force exerted in the direction away from concrete 124 on coupler 106 by housing rod 104 and the force exerted in the direction towards concrete 124 on coupler 106 by anchor bolt 108 places coupler 106 in tension. Fuse 106*c* of coupler 106 is formed to be the intentional weak link in the load path between base plate 114 and concrete 124 so that fuse 106*c* deforms in a ductile manner before failure of concrete 124, anchor bolt 108, base plate 114, or any other portion of fuse assembly 100. Fuse 106*c* deforms in a ductile manner when a tensile stress in fuse 106*c* exceeds an elastic limit of the fuse 106*c* in a similar manner as described above for fuses 14*a-f*.

After fuse 106*c* deforms, the deformed fuse assembly 100 may be removed from threaded engagement with anchor bolt 108 and replaced with another fuse assembly 100. The deformed fuse assembly 100 may be removed and replaced without altering or damaging the concrete 124, anchor bolt 108, baseplate 114, and the structure joined to the baseplate 114.

Fuse assembly 100 may be made from any of the materials specified above for fuse assembly 10. Further, the dimensions of fuse assembly 100 and materials from which fuse assembly 100 are made may be altered so that fuse assembly 100 is designed to deform at any predetermined force, which may be marked on the assembly 100 in a similar manner as described above with respect to assembly 10. The invention may also include a plurality of different fuse assemblies 100 in a similar manner as described above with respect to assembly 10. Fuse assembly 100 may also be used in orientations other than the vertical orientation shown in FIG. 4A in a similar manner as described above with respect to fuse assembly 10.

Figure 5A:
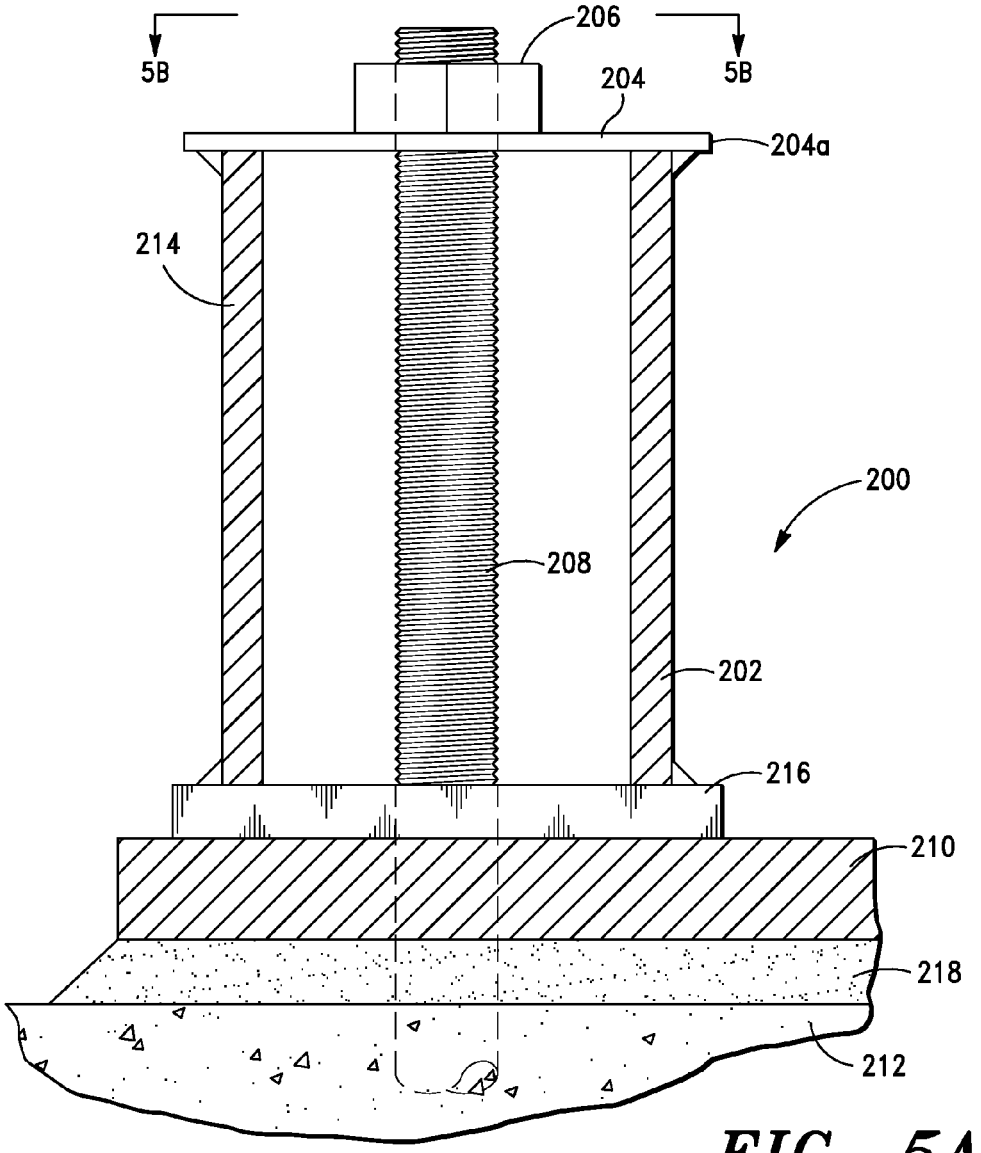
FIG. 5A is a side partial cross-sectional view of an alternative embodiment of fuse assembly in accordance with the present invention.
Figure 5B:
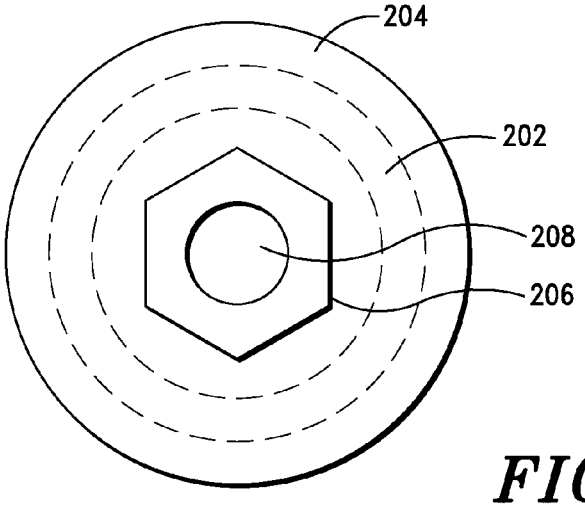
FIG. 5B is a top plan view of the fuse assembly shown in FIG. 5A.

Referring to FIG. 5A, an alternative embodiment of fuse assembly is identified generally as 200. Fuse assembly 200 includes a housing 202 and a fuse 204 joined to one end of the housing 202. A nut 206 engages an anchor bolt 208 and abuts the fuse 204 to clamp a base plate 210 between the housing 202 and concrete 212, within which anchor bolt 208 is embedded. Housing 202 includes a cylindrical tube 214 and a circular bottom plate 216 welded to a lower end of the tube 214. Bottom plate 216 abuts base plate 210. Bottom plate 216 and base plate 210 have aligned openings to receive anchor bolt 208. Baseplate 210 is positioned on top of optional grout 218 and concrete 212.

Fuse 204 is a circular plate that is joined to an upper end of the tube 214, preferably by welding. Fuse 204 includes a central opening that receives a portion of anchor bolt 208. Fuse 204 is a relatively thin plate compared to the thickness of tube 214 and bottom plate 216 so that fuse 204 deforms in a ductile manner before failure of housing 202, anchor bolt 208, baseplate 210, or concrete 212. Fuse 204 is formed from a ductile material having an elastic limit in a similar manner as the fuses 14*a-f* described above. A portion of fuse 204 near its outer edge 204*a* is positioned above tube 214. Nut 206 abuts a central portion of fuse 204. There is a radial space between the outer edge of nut 206 and the portion of fuse 204 supported by tube 214.

Fuse assembly 200 is coupled to anchor bolt 208 via nut 206 to clamp baseplate 210 between fuse assembly 200 and concrete 212. Fuse assembly 200 is installed by placing it over anchor bolt 208 and then threading nut 206 on anchor bolt 208.

When a structure joined to baseplate 210 is subjected to a loading event that exerts a force in the direction away from concrete 212 on the structure and baseplate 210, baseplate 210 exerts a force in the direction away from concrete 212 on housing 202. Housing 202 exerts a force in the direction away from concrete 212 on an outer portion of fuse 204. Nut 206 exerts a force in the direction towards concrete 212 on a central portion of fuse 204. Because there is a radial gap between the outer edge of nut 206 and the portion of fuse 204 supported by tube 214, the force exerted in the direction away from concrete 212 on the fuse 204 by housing 202 and the force exerted in the direction towards concrete 212 on the fuse 204 by nut 206 places the portion of fuse 204 between nut 206 and housing 202 in flexure. Fuse 204 is formed to be the intentional weak link in the load path between base plate 210 and concrete 212 so that fuse 204 deforms in a ductile manner before failure of concrete 212, anchor bolt 208, base plate 210, or any other portion of fuse assembly 200. Fuse 204 deforms in a ductile manner when a stress in fuse 204 caused by flexure of the fuse 204 exceeds an elastic limit of the fuse 204 and causes the fuse 204 to deform plastically in a similar manner as described above for fuses 14*a-f*.

After fuse 204 deforms, the deformed fuse assembly 200 may be removed from anchor bolt 208 and replaced with another fuse assembly 200. The deformed fuse assembly 200 may be removed and replaced without altering or damaging the concrete 212, anchor bolt 208, baseplate 210, and the structure joined to the baseplate 210.

Fuse assembly 200 may be made from any of the materials specified above for fuse assembly 10. Further, the dimensions of fuse assembly 200 and materials from which fuse assembly 200 are made may be altered so that fuse assembly 200 is designed to deform at any predetermined force, which may be marked on the assembly 200 in a similar manner as described above with respect to assembly 10. The invention may also include a plurality of different fuse assemblies 200 in a similar manner as described above with respect to assembly 10. Fuse assembly 200 may also be used in orientations other than the vertical orientation shown in FIG. 5A in a similar manner as described above with respect to fuse assembly 10.

Figure 6A:
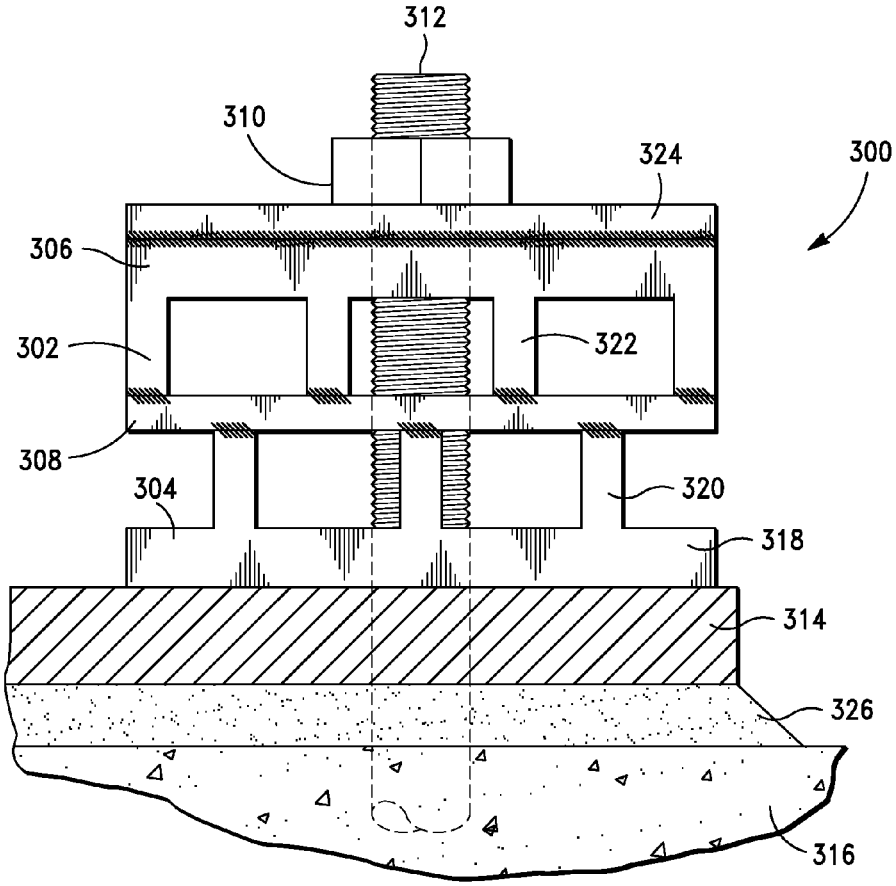
FIG. 6A is a side view of an alternative embodiment of fuse assembly in accordance with the present invention.
Figure 6B:
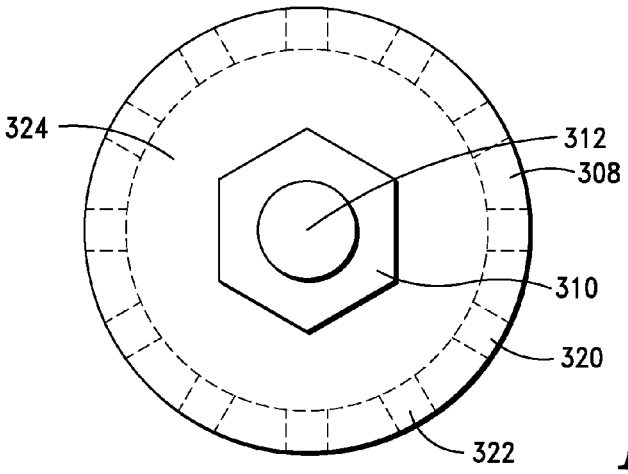
FIG. 6B is a top plan view of the fuse assembly shown in FIG. 6A.

Another embodiment of fuse assembly in accordance with the present invention is identified generally as 300 in FIG. 6A.

Fuse assembly 300 includes a housing 302 having first and second sections 304 and 306. An annular fuse 308 is positioned between the first and second sections 304 and 306. Fuse 308 is formed from a ductile material having an elastic limit in a similar manner as the fuses 14*a-f* described above. A nut 310 engages an anchor bolt 312 and abuts second section 306 to clamp a base plate 314 between first section 304 of housing 302 and concrete 316, within which anchor bolt 312 is embedded.

First section 304 of housing 302 includes an annular plate 318 that abuts baseplate 314 and a plurality of spaced apart teeth, one of which is identified as 320, extending from plate 318 adjacent the outer edge of plate 318. Second section 306 of housing 302 has a similar configuration as first section 304 except that second section 306 is inverted so that teeth 322 on second section 306 face the teeth 320 on first section 304. The second section 306 is also rotated with respect to the first section 304 such that the teeth 320 on first section 304 are not aligned with the teeth 322 on second section 306. Each of the teeth 320 and 322 is welded, or otherwise attached, to fuse 308. First and second sections 304 and 306 include aligned openings to receive anchor bolt 312. Nut 310 abuts a circular plate 324 of second section 306.

Fuse assembly 300 is coupled to anchor bolt 312 via nut 310 to clamp baseplate 314 between fuse assembly 300 and concrete 316. Baseplate 314 is positioned on top of optional grout 326 and concrete 316. Fuse assembly 300 is installed by placing it over anchor bolt 312 and then threading nut 310 on anchor bolt 312.

When a structure joined to baseplate 314 is subjected to a loading event that exerts a force in the direction away from concrete 316 on the structure and baseplate 314, baseplate 314 exerts a force in the direction away from concrete 316 on first section 304 of housing 302. The teeth 320 on first section 304 exert a force in the direction away from concrete 316 on fuse 308. The teeth 322 on second section 306 exert a force in the direction towards concrete 316 on fuse 308 via their coupling with anchor rod 312. Because teeth 320 are spaced from teeth 322, the force exerted in the direction away from concrete 316 on the fuse 308 by first section 304 and the force exerted in the direction towards concrete 316 on the fuse 308 by second section 306 places the portions of fuse 308 between teeth 320 and teeth 322 in flexure. Fuse 308 is formed to be the intentional weak link in the load path between base plate 314 and concrete 316 so that fuse 308 deforms in a ductile manner before failure of concrete 316, anchor bolt 312, base plate 314, or any other portion of fuse assembly 300. Fuse 308 deforms in a ductile manner when a stress in fuse 308 caused by flexure of the fuse 308 exceeds an elastic limit of the fuse 308 and causes the fuse 308 to deform plastically in a similar manner as described above for fuses 14*a-f*.

After fuse 308 deforms, the deformed fuse assembly 300 may be removed from anchor bolt 312 and replaced with another fuse assembly 300. The deformed fuse assembly 300 may be removed and replaced without altering or damaging the concrete 316, anchor bolt 312, baseplate 314, and the structure joined to the baseplate 314.

Fuse assembly 300 may be made from any of the materials specified above for fuse assembly 10. Further, the dimensions of fuse assembly 300 and materials from which fuse assembly 300 are made may be altered so that fuse assembly 300 is designed to deform at any predetermined force, which may be marked on the assembly 300 in a similar manner as described above with respect to assembly 10. The invention may also include a plurality of different fuse assemblies 300 in a similar manner as described above with respect to assembly 10. Fuse assembly 300 may also be used in orientations other than the vertical orientation shown in FIG. 6A in a similar manner as described above with respect to fuse assembly 10.

Figure 7A:
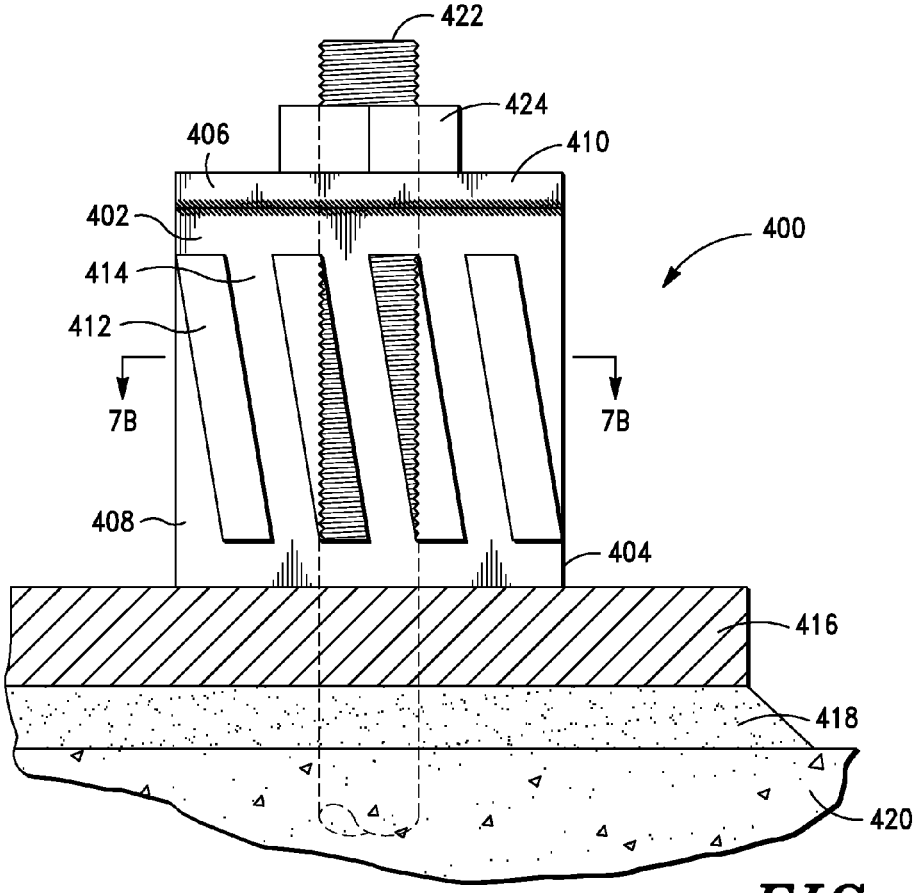
FIG. 7A is a side view of an alternative embodiment of fuse assembly in accordance with the present invention.
Figure 7B:
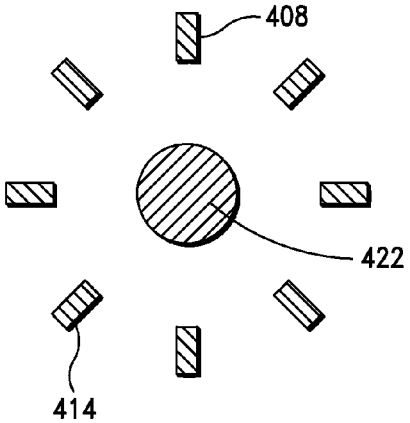
FIG. 7B is a cross-sectional view taken through the line 7B-7B in FIG. 7A.

Referring to FIG. 7A, a further embodiment of fuse assembly in accordance with the present invention is identified generally as 400. Fuse assembly 400 includes a housing 402 having first and second ends 404 and 406. Housing 402 is formed from a cylindrical tube 408 with an outer wall surrounding an inner channel. A circular plate 410 is welded to the tube 408 at the second end 406. Slots, one of which is identified as 412, are cut through the outer wall of tube 408. Strips, one of which is identified as 414, are positioned between adjacent slots 412. The strips 414 have a generally rectangular cross-section as shown in FIG. 7B. Slots 412 and strips 414 extend from just above first end 404 to just below second end 406. Slots 412 and strips 414 are positioned at an angle with respect to vertical. Slots 412 and strips 414 form a fuse of the fuse assembly 400. Strips 414 are formed from a ductile material having an elastic limit in a similar manner as the fuses 14*a-f* described above.

A lower surface at the first end 404 of housing 402 abuts a baseplate 416 of a structure, which is positioned on top of optional grout 418 and concrete 420. An anchor bolt 422 embedded in concrete 420 extends through an opening in baseplate 416, the center of housing 402, and an opening in plate 410. A nut 424 is threaded on the end of anchor bolt 422 and abuts plate 410.

Fuse assembly 400 is coupled to anchor bolt 422 via nut 424 to clamp baseplate 416 between fuse assembly 400 and concrete 420. Fuse assembly 400 is installed by placing it over anchor bolt 422 and then threading nut 424 on anchor bolt 422.

When a structure joined to baseplate 416 is subjected to a loading event that exerts a force in the direction away from concrete 420 on the structure and baseplate 416, baseplate 416 exerts a force in the direction away from concrete 420 on first end 404 of housing 402. The first end 404 of housing 402 exerts a force in the direction away from concrete 420 on the strips 414 making up the fuse of the fuse assembly 400. The second end 406 of housing 402 exerts a force in the direction towards concrete 420 on the strips 414 via the coupling between the second end 406 and nut 424. The forces exerted on the strips 414 place them in compression. Strips 414 are formed to be the intentional weak link in the load path between base plate 416 and concrete 420 so that strips 414 deform in a ductile manner before failure of concrete 420, anchor bolt 422, base plate 416, or any other portion of fuse assembly 400. Strips 414 deform in a ductile manner when a stress in each of strips 414 caused by compression exceeds an elastic limit of the strips 414 and causes the strips 414 to deform plastically in a similar manner as described above for fuses 14*a-f*.

After strips 414 deform, the deformed fuse assembly 400 may be removed from anchor bolt 422 and replaced with another fuse assembly 400. The deformed fuse assembly 400 may be removed and replaced without altering or damaging the concrete 420, anchor bolt 422, baseplate 416, and the structure joined to the baseplate 416.

Fuse assembly 400 may be made from any of the materials specified above for fuse assembly 10. Further, the dimensions of fuse assembly 400 and materials from which fuse assembly 400 are made may be altered so that fuse assembly 400 is designed to deform at any predetermined force, which may be marked on the assembly 400 in a similar manner as described above with respect to assembly 10. The invention may also include a plurality of different fuse assemblies 400 in a similar manner as described above with respect to assembly 10. Fuse assembly 400 may also be used in orientations other than the vertical orientation shown in FIG. 7A in a similar manner as described above with respect to fuse assembly 10.

Figure 8A:
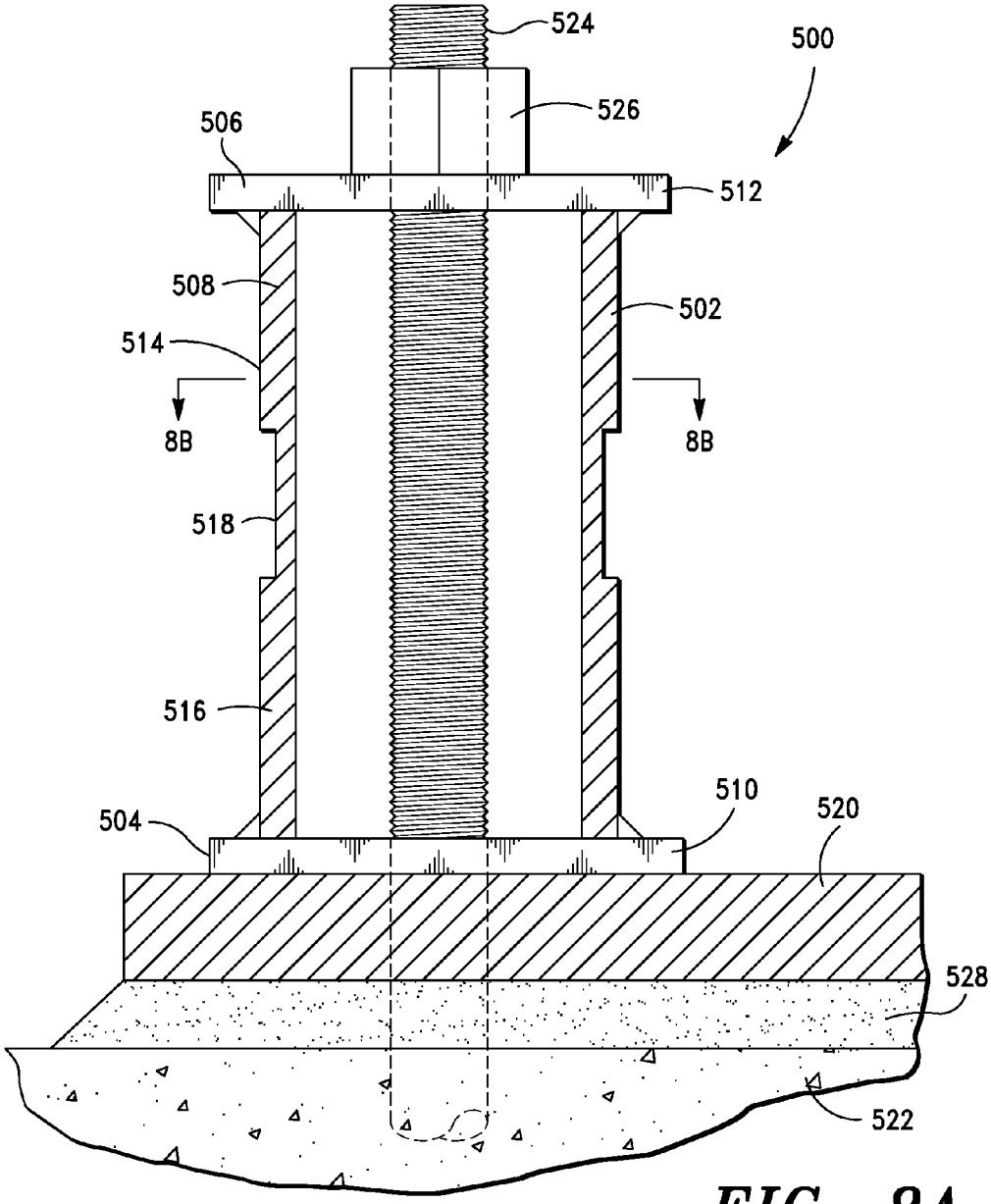
FIG. 8A is a side partial cross-sectional view of an alternative embodiment of fuse assembly in accordance with the present invention.
Figure 8B:
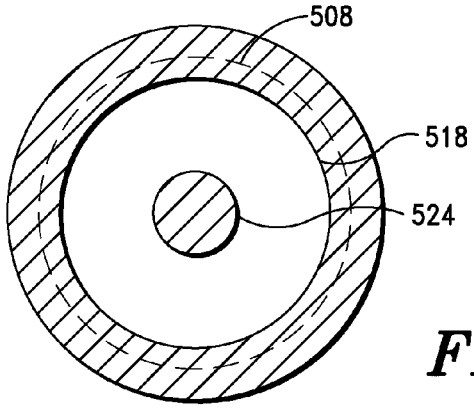
FIG. 8B is a cross-sectional view taken through the line 8B-8B in FIG. 8A.

An alternative embodiment of fuse assembly is identified in FIG. 8A generally as 500. Fuse assembly 500 includes a housing 502 having first and second ends 504 and 506. Housing 502 is formed from a cylindrical tube 508 with an outer wall surrounding an inner channel. A circular plate 510 is welded to the tube 508 at the first end 504, and another circular plate 512 is welded to the tube 508 at the second end 506. Tube 508 includes upper and lower portions 514 and 516 having the same wall thickness, and a middle portion 518 having a wall thickness that is less than the wall thickness of the upper and lower portions 514 and 516. Middle portion 518 forms a fuse of the fuse assembly 500. Middle portion 518 is formed from a ductile material having an elastic limit in a similar manner as the fuses 14*a-f* described above.

Plate 510 of housing 502 abuts a baseplate 520 of a structure, which is positioned on top of concrete 522. An anchor bolt 524 embedded in concrete 522 extends through aligned openings in baseplate 520 and plate 510, the center of housing 502, and an opening in plate 512. A nut 526 is threaded on the end of anchor bolt 524 and abuts plate 512.

Fuse assembly 500 is coupled to anchor bolt 524 via nut 526 to clamp baseplate 520 between fuse assembly 500 and concrete 522. Baseplate 520 is positioned on top of optional grout 528 and concrete 522. Fuse assembly 500 is installed by placing it over anchor bolt 524 and then threading nut 526 on anchor bolt 524.

When a structure joined to baseplate 520 is subjected to a loading event that exerts a force in the direction away from concrete 522 on the structure and baseplate 520, baseplate 520 exerts a force in the direction away from concrete 522 on first end 504 of housing 502. The lower portion 516 of tube 508 exerts a force in the direction away from concrete 522 on middle portion 518, which makes up the fuse of the fuse assembly 500. The upper portion 514 of tube 508 exerts a force in the direction towards concrete 522 on middle portion 518 via the coupling between the second end 506 and nut 526. The forces exerted on the middle portion 518 places it in compression. Middle portion 518 is formed to be the intentional weak link in the load path between base plate 520 and concrete 522 so that middle portion 518 deforms in a ductile manner before failure of concrete 522, anchor bolt 524, base plate 520, or any other portion of fuse assembly 500. Middle portion 518 deforms in a ductile manner when a stress in middle portion 518 caused by compression exceeds an elastic limit of the middle portion 518 and causes the middle portion 518 to deform plastically due to eccentric loading of middle portion 518 from upper and lower portions 514 and 516 in a similar manner as described above for fuses 14*a-f*.

After middle portion 518 deforms, the deformed fuse assembly 500 may be removed from anchor bolt 524 and replaced with another fuse assembly 500. The deformed fuse assembly 500 may be removed and replaced without altering or damaging the concrete 522, anchor bolt 524, baseplate 520, and the structure joined to the baseplate 520.

Fuse assembly 500 may be made from any of the materials specified above for fuse assembly 10. Further, the dimensions of fuse assembly 500 and materials from which fuse assembly 500 are made may be altered so that fuse assembly 500 is designed to deform at any predetermined force, which may be marked on the assembly 500 in a similar manner as described above with respect to assembly 10. The invention may also include a plurality of different fuse assemblies 500 in a similar manner as described above with respect to assembly 10. Fuse assembly 500 may also be used in orientations other than the vertical orientation shown in FIG. 8A in a similar manner as described above with respect to fuse assembly 10.

Figure 9A:
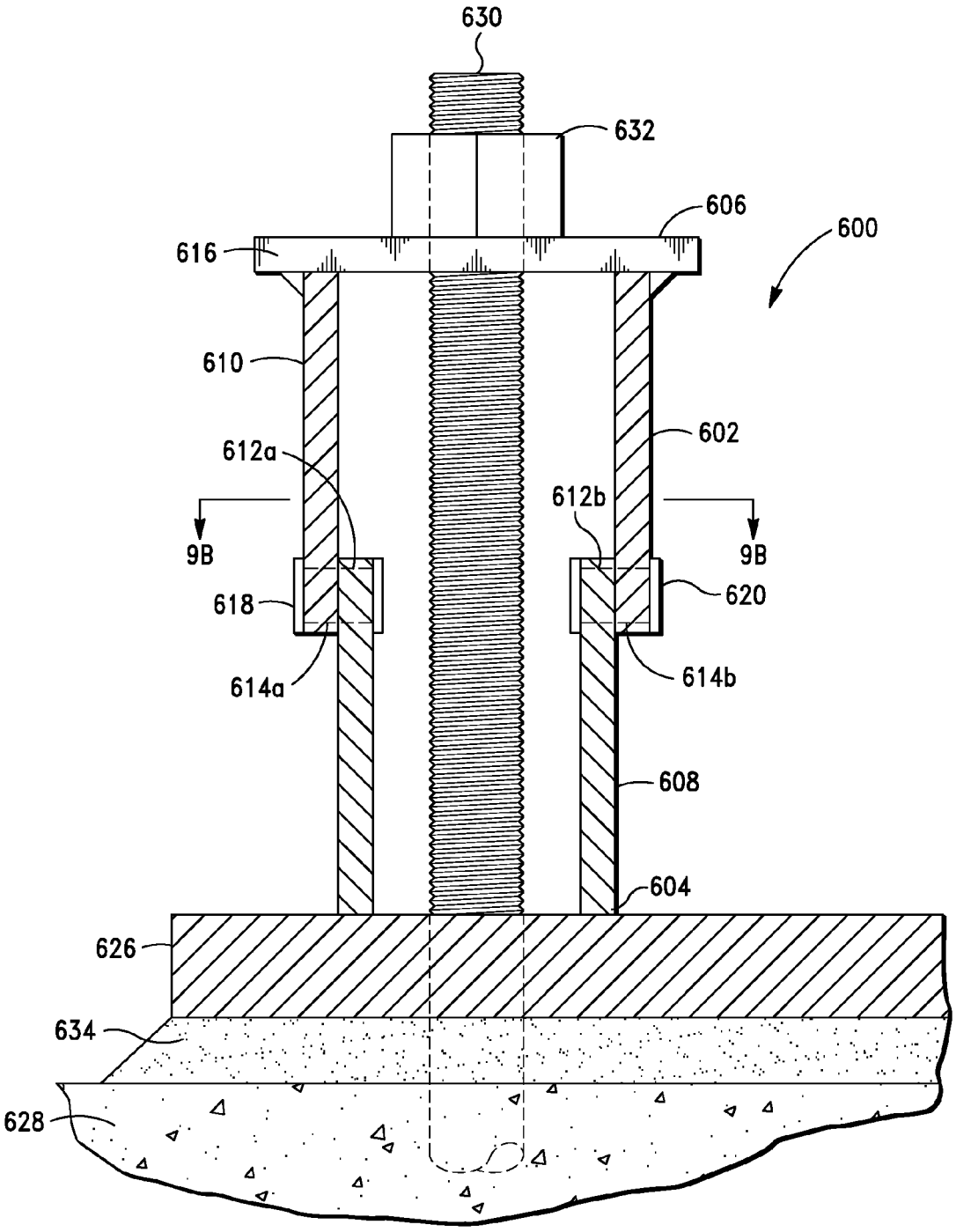
FIG. 9A is a side partial cross-sectional view of an alternative embodiment of fuse assembly in accordance with the present invention.

A fuse assembly in accordance with another alternative embodiment of the present invention is identified generally as 600 in FIG. 9A. Fuse assembly 600 includes a housing 602 having first and second ends 604 and 606. Housing 602 has a first section 608 extending from first end 604 to a midpoint of housing 602 and a second section 610 extending from a midpoint of housing 602 to second end 606. Each of first and second sections 608 and 610 are cylindrical tubes. First section 608 has an outer diameter that is slightly smaller than an inner diameter of second section 610 such that second section 610 can receive a portion of first section 608. Two holes 612*a-b* extend through an upper end of first section 608, and two holes 614*a-b* extend through a lower end of second section 610. In use, first section 608 is inserted into second section 610 so that holes 612*a* and 614*a* are aligned and holes 612*b* and 614*b* are aligned. A circular plate 616 is welded to an upper end of second section 610.

Figure 9B:
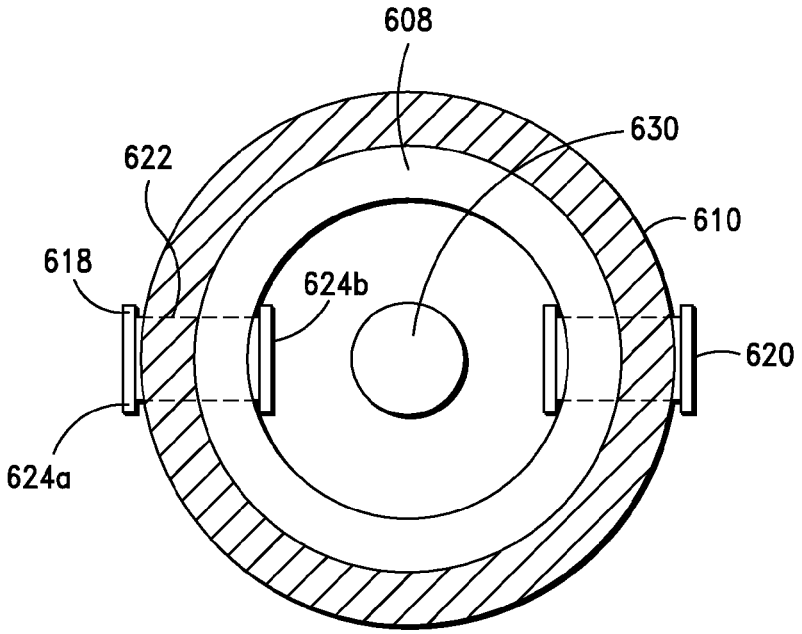
FIG. 9B is a cross-sectional view taken through the line 9B-9B in FIG. 9A showing an embodiment of fuse assembly having a circular cross-section.

A fuse 618 is inserted through the aligned openings 612*a* and 614*a*, and a fuse 620 is inserted through the aligned openings 612*b* and 614*b*. Fuses 618 and 620 are substantially similar. Accordingly, only the structure of fuse 618 is described in detail herein. Referring to FIG. 9B, fuse 618 includes a cylindrical pin 622 and outer and inner flanges 624*a-b* joined to either end of pin 622. Outer flange 624*a* abuts an outer surface of second section 610, and inner flange 624*b* abuts an inner surface of first section 608. Cylindrical pin 622 has an outer diameter that is slightly less than the diameter of aligned openings 612*a* and 614*a* in first and second sections 608 and 610, respectively. Outer and inner flanges 624*a-b* each have a diameter that is slightly larger than the diameter of aligned openings 612*a* and 614*a* for retaining fuse 618 within the openings 612*a* and 614*a*. Fuses 618 and 620 are each formed from a ductile material having an elastic limit in a similar manner as the fuses 14*a-f* described above.

A lower surface of first section 608 abuts a baseplate 626 of a structure, which is positioned on top of concrete 628. An anchor bolt 630 embedded in concrete 628 extends through an opening in baseplate 626, the center of housing 602, and an opening in plate 616. A nut 632 is threaded on the end of anchor bolt 630 and abuts plate 616.

Fuse assembly 600 is coupled to anchor bolt 630 via nut 632 to clamp baseplate 626 between fuse assembly 600 and concrete 628. Baseplate 626 is positioned on top of optional grout 634 and concrete 628. Fuse assembly 600 is installed by placing it over anchor bolt 630 and then threading nut 632 on anchor bolt 630.

When a structure joined to baseplate 626 is subjected to a loading event that exerts a force in the direction away from concrete 628 on the structure and baseplate 626, baseplate 626 exerts a force in the direction away from concrete 628 on first section 608 of housing 602. First section 608 exerts a force in the direction away from concrete 628 on the portions of fuses 618 and 620 positioned within the openings 612*a-b* of first section 608. Second section 610 exerts a force in the direction towards concrete 628 on the portions of fuses 618 and 620 positioned within the openings 614*a-b* of second section 610 via the coupling between the second section 610 and nut 632. The forces exerted on fuses 618 and 620 places them in shear. Fuses 618 and 620 are formed to be the intentional weak link in the load path between base plate 626 and concrete 628 so that fuses 618 and 620 deform in a ductile manner before failure of concrete 628, anchor bolt 630, base plate 626, or any other portion of fuse assembly 600. Fuses 618 and 620 deform in a ductile manner when a stress in each of fuses 618 and 620 caused by shear exceeds an elastic limit of the fuses 618 and 620 and causes the fuses 618 and 620 to deform plastically in a similar manner as described above for fuses 14*a-f*.

After fuses 618 and 620 deform, the deformed fuse assembly 600 may be removed from anchor bolt 630 and replaced with another fuse assembly 600. The deformed fuse assembly 600 may be removed and replaced without altering or damaging the concrete 628, anchor bolt 630, baseplate 626, and the structure joined to the baseplate 626.

Fuse assembly 600 may be made from any of the materials specified above for fuse assembly 10. Further, the dimensions of fuse assembly 600 and materials from which fuse assembly 600 are made may be altered so that fuse assembly 600 is designed to deform at any predetermined force, which may be marked on the assembly 600 in a similar manner as described above with respect to assembly 10. The invention may also include a plurality of different fuse assemblies 600 in a similar manner as described above with respect to assembly 10. Fuse assembly 600 may also be used in orientations other than the vertical orientation shown in FIG. 9A in a similar manner as described above with respect to fuse assembly 10.

Figure 9C:
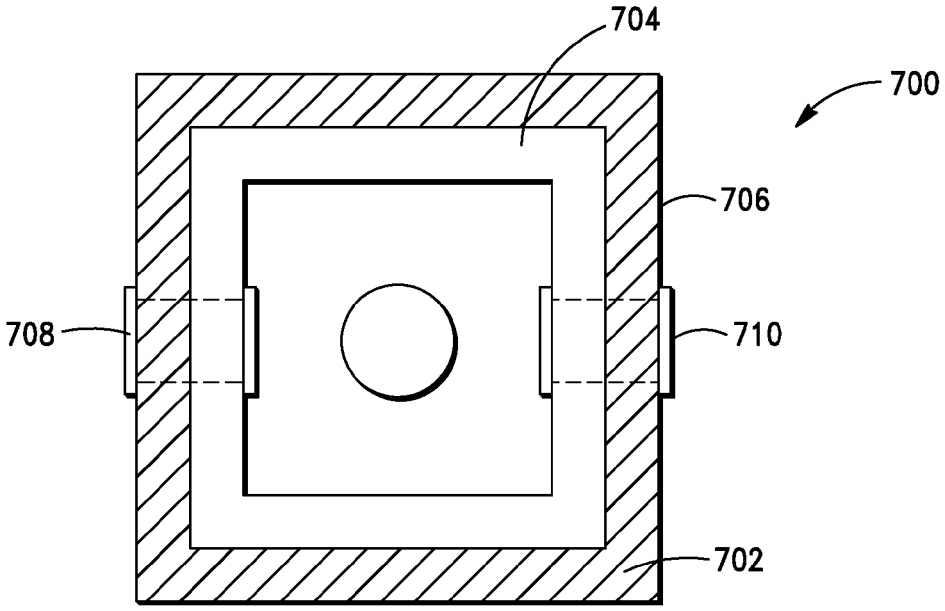
FIG. 9C is a cross-sectional view of an alternative embodiment of fuse assembly similar to the one shown in FIGS. 9A-B but having a square cross-section.

FIG. 9C shows an alternative embodiment of fuse assembly 700, which is substantially similar to fuse assembly 600 except that fuse assembly 700 has a housing 702 with first and second sections 704 and 706 that have a square cross-section instead of the circular cross-section of first and second sections 608 and 610 shown in FIG. 9B. Fuse assembly 700 has fuses 708 and 710 that operate in a similar manner as fuses 618 and 620 described above.

Figure 10A:
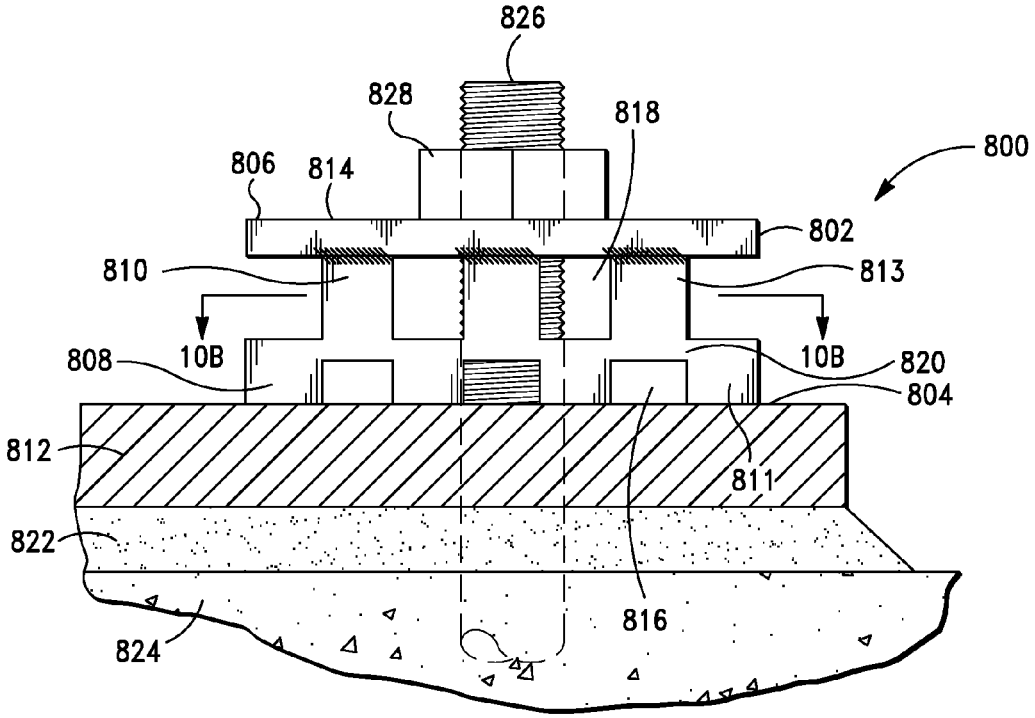
FIG. 10A is a side view of an alternative embodiment of fuse assembly in accordance with the present invention.
Figure 10B:
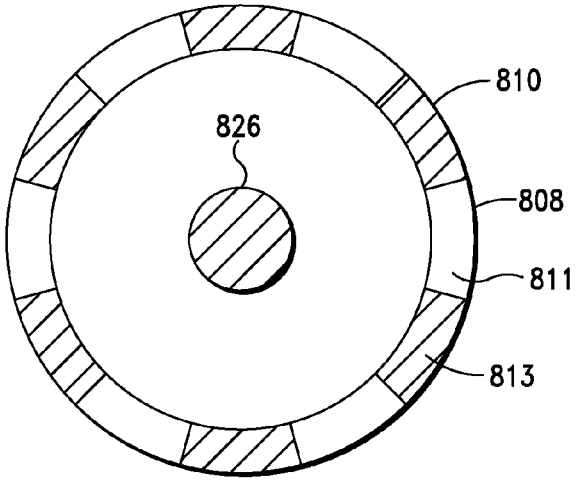
FIG. 10B is a cross-sectional view taken through the line 10B-10B in FIG. 10A.

Another alternative embodiment of fuse assembly in accordance with the present invention is identified generally as 800 in FIG. 10A. Fuse assembly 800 includes a housing 802 having first and second ends 804 and 806. Housing 802 has a first section 808 extending from first end 804 to a midpoint of housing 802 and a second section 810 extending from a midpoint of housing 802 to second end 806. The first and second sections 808 and 810 form a ring in which protrusions of the first section 808, one of which is shown as 811, extend from the second section 810 and abut a baseplate 812. Protrusions of the second section 810, one of which is shown as 813, extend from the first section 808 and are joined to a circular plate 814.

First section 808 has six protrusions 811, and second section 810 has six protrusions 813. Each of protrusions 811 is joined to two of protrusions 813, and each of protrusions 813 is joined to two of protrusions 811. Gaps, one of which is shown as 816, are formed between adjacent protrusions 811 beneath the protrusion 813 to which the adjacent protrusions 811 are joined, and gaps, one of which is shown as 818, are formed between adjacent protrusions 813 above the protrusion 811 to which the adjacent protrusions 813 are joined. Protrusions 811 and 813 are joined at an area 820. The combination of the areas 820 where adjacent protrusions 811 and 813 are joined forms a fuse. Protrusions 811 and 813 are formed from a ductile material having an elastic limit in a similar manner as the fuses 14*a-f* described above.

Baseplate 812 is positioned on top of optional grout 822 and concrete 824. An anchor bolt 826 embedded in concrete 824 extends through an opening in baseplate 812, the center of housing 802, and an opening in plate 814. A nut 828 is threaded on the end of anchor bolt 826 and abuts plate 814.

Fuse assembly 800 is coupled to anchor bolt 826 via nut 828 to clamp baseplate 812 between fuse assembly 800 and concrete 824. Fuse assembly 800 is installed by placing it over anchor bolt 826 and then threading nut 828 on anchor bolt 826.

When a structure joined to baseplate 812 is subjected to a loading event that exerts a force in the direction away from concrete 824 on the structure and baseplate 812, baseplate 812 exerts a force in the direction away from concrete 824 on first section 808 of housing 802. Nut 828 exerts a force in the direction towards concrete 824 on the second section 810 of housing 802. The forces exerted on first and second sections 808 and 810 places the areas 820 where adjacent protrusions 811 and 813 are joined, or the fuse, in shear. The areas 820 where adjacent protrusions 811 and 813 are joined are formed to be the intentional weak link in the load path between base plate 812 and concrete 824 so that these areas 820 deform in a ductile manner before failure of concrete 824, anchor bolt 826, base plate 812, or any other portion of fuse assembly 800. The areas 820 deform in a ductile manner when a stress in each of the areas 820 caused by shear exceeds an elastic limit of the areas 820 and causes the areas 820 to deform plastically in a similar manner as described above for fuses 14*a-f*.

After the areas 820 deform, the deformed fuse assembly 800 may be removed from anchor bolt 826 and replaced with another fuse assembly 800. The deformed fuse assembly 800 may be removed and replaced without altering or damaging the concrete 824, anchor bolt 826, baseplate 812, and the structure joined to the baseplate 812.

Fuse assembly 800 may be made from any of the materials specified above for fuse assembly 10. Further, the dimensions of fuse assembly 800 and materials from which fuse assembly 800 are made may be altered so that fuse assembly 800 is designed to deform at any predetermined force, which may be marked on the assembly 800 in a similar manner as described above with respect to assembly 10. The invention may also include a plurality of different fuse assemblies 800 in a similar manner as described above with respect to assembly 10. Fuse assembly 800 may also be used in orientations other than the vertical orientation shown in FIG. 10A in a similar manner as described above with respect to fuse assembly 10.

In use, each of fuse assemblies 10, 100, 200, 300, 400, 500, 600, 700, and 800 is coupled to an anchor bolt, as described above, so that the respective fuse assembly is in the load path between the structure and the anchor bolt. The baseplate may have a plurality of holes each receiving an anchor rod to which one of fuse assemblies 10, 100, 200, 300, 400, 500, 600, 700, and 800 is coupled. Further, the structure may have a plurality of baseplates each receiving anchor rods to which one of fuse assemblies 10, 100, 200, 300, 400, 500, 600, 700, and 800 is coupled. If the structure is subjected to a loading event that exerts a force in the direction away from the concrete surface on the structure and baseplate, the fuse assembly 10, 100, 200, 300, 400, 500, 600, 700, and 800 will deform in a ductile manner when a stress caused in the fuse assembly 10, 100, 200, 300, 400, 500, 600, 700, and 800 from the force in the direction away from the concrete surface exceeds an elastic limit of the fuse assembly 10, 100, 200, 300, 400, 500, 600, 700, and 800 as described above in detail for each of fuse assemblies 10, 100, 200, 300, 400, 500, 600, 700, and 800. As described above, fuse assemblies 10, 100, 200, 300, 400, 500, 600, 700, and 800 may be used in an orientation other than the vertical orientation shown in the drawings.

After the fuse assembly 10, 100, 200, 300, 400, 500, 600, 700, and 800 deforms, the deformation is visual by a person viewing the fuse assembly. The deformed fuse assembly 10, 100, 200, 300, 400, 500, 600, 700, and 800 may be removed, discarded, and replaced with another like fuse assembly that has not deformed. This process may be accomplished without significantly altering or damaging the concrete within which the anchor bolt is embedded, the anchor bolt, baseplate, and/ or structure. Further, the deformed fuse assembly can be replaced with a new fuse assembly with no decrease in connection performance. Installing and removing each of fuse assemblies 10, 100, 200, 300, 400, 500, 600, 700, and 800 preferably only requires a conventional sized wrench or socket readily available on a typical construction site.

When each of the fuse assemblies 10, 100, 200, 300, 400, 500, 600, 700, and 800 is used to couple a structure to a concrete embedded anchor, the connection between the structure and anchor preferably complies with the requirements of the American Concrete Institute's Building Code Requirements for Structural Concrete (ACI 318).

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letter Patent is as follows:

1. A method for coupling a structure to an anchor, comprising:

removably coupling at least one fuse to the anchor so that the fuse is positioned in a load path between the anchor and the structure, wherein the fuse is configured to deform in a ductile manner when the structure exerts a force on the fuse that causes a tensile stress in the fuse which exceeds an elastic limit of the fuse, wherein the fuse may be decoupled from the anchor without altering the anchor and the structure, and wherein the fuse is a portion of a fuse assembly comprising:

a connector that is coupled to the fuse, wherein the step of removably coupling at least one fuse to the anchor comprises removably coupling the connector to the anchor; and a housing that is coupled to the fuse such that the fuse is in a load path between the housing and the connector, wherein the fuse is configured to deform in a ductile manner when a force exerted on the housing by the structure causes a stress in the fuse which exceeds an elastic limit of the fuse, wherein the housing comprises a first end that is positioned adjacent the structure when the connector is coupled to the anchor, wherein the fuse comprises a first end that is coupled to a second end of the housing, wherein the fuse comprises a second end that is coupled to the connector, wherein the housing comprises an outer surface with a hexagonal cross-section, and wherein the housing comprises an inner surface surrounding a channel within which at least a portion of the fuse and at least a portion of the connector are positioned.

2. The method of claim 1, wherein the anchor is at least partially embedded in concrete, and wherein the fuse may be decoupled from the anchor without altering the concrete.

3. The method of claim 1, further comprising decoupling the fuse from the anchor after the fuse deforms in a ductile manner.

4. The method of claim 3, further comprising coupling another fuse to the anchor after decoupling from the anchor the fuse that deformed in a ductile manner.

5. A method for coupling a structure to an anchor with a fuse assembly comprising a housing, at least one fuse coupled to the housing, and a connector coupled to the fuse, wherein the connector comprises a first set of threads, and wherein the anchor comprises a second set of threads, the method comprising:

removably coupling the fuse assembly to the anchor by engaging the first set of threads with the second set of threads and rotating the housing, the fuse, and the connector of the fuse assembly with respect to the anchor, wherein the fuse assembly is coupled to the anchor so that the fuse assembly is positioned in a load path between the anchor and the structure, wherein the fuse assembly may be decoupled from the anchor without altering the anchor and the structure, wherein the housing comprises an outer surface and an inner surface surrounding a channel, wherein at least a portion of the connector is positioned in the channel; and wherein the fuse is coupled to the housing and to the connector such that the fuse is in a load path between the housing and the connector, wherein at least a portion of the fuse is positioned in the channel, and wherein the fuse is configured to deform in a ductile manner when the structure exerts a force on the housing that causes a stress in the fuse which exceeds an elastic limit of the fuse.

6. The method of claim 5, wherein the anchor is at least partially embedded in concrete, and wherein the fuse assembly may be decoupled from the anchor without altering the concrete.

7. The method of claim 5, further comprising decoupling the fuse assembly from the anchor after the fuse deforms in a ductile manner.

8. The method of claim 7, further comprising coupling another fuse assembly to the anchor after decoupling from the anchor the fuse that deformed in a ductile manner.

9. The method of claim 5, wherein when the structure exerts a force on the housing, the structure causes a tensile stress in the fuse.

10. The method of claim 5, wherein the housing comprises a first end that is positioned adjacent the structure when the connector is coupled to the anchor, wherein the fuse comprises a first end that is coupled to a second end of the housing, and wherein the fuse comprises a second end that is coupled to the connector.

11. The method of claim 5, wherein the outer surface of the housing has a hexagonal cross-section.

12. A method for coupling a structure to an anchor with a fuse assembly comprising a housing, at least one fuse coupled to the housing, and a connector coupled to the fuse, wherein the connector comprises a first set of threads, and wherein the anchor comprises a second set of threads, the method comprising:

removably coupling the fuse assembly to the anchor by engaging the first set of threads with the second set of threads and rotating the housing, the fuse, and the connector of the fuse assembly with respect to the anchor, wherein the fuse assembly is coupled to the anchor so that the fuse assembly is positioned in a load path between the anchor and the structure, wherein the fuse assembly may be decoupled from the anchor without altering the anchor and the structure, and wherein the housing is coupled to the fuse such that the fuse is in a load path between the housing and the connector, wherein the fuse is configured to deform in a ductile manner when the structure exerts a force on the housing that causes a compressive stress in the housing and a tensile stress in the fuse which exceeds an elastic limit of the fuse.

13. The method of claim 12, wherein the anchor is at least partially embedded in concrete, and wherein the fuse assembly may be decoupled from the anchor without altering the concrete.

14. The method of claim 12, further comprising decoupling the fuse assembly from the anchor after the fuse deforms in a ductile manner.

15. The method of claim 14, further comprising coupling another fuse assembly to the anchor after decoupling from the anchor the fuse that deformed in a ductile manner.

16. The method of claim 12, wherein the housing comprises a first end that is positioned adjacent the structure when the connector is coupled to the anchor, wherein the fuse comprises a first end that is coupled to a second end of the housing, and wherein the fuse comprises a second end that is coupled to the connector.

17. The method of claim 12, wherein the housing comprises an outer surface, and wherein the housing comprises an inner surface surrounding a channel within which at least a portion of the fuse and at least a portion of the connector are positioned.

18. The method of claim 17, wherein the outer surface of the housing has a hexagonal cross-section.

* * * * *